United States Patent [19]

Kawamo et al.

[11] Patent Number: 4,592,789

[45] Date of Patent: Jun. 3, 1986

[54] PROCESS FOR PRODUCING A GRAIN-ORIENTED ELECTROMAGNETIC STEEL SHEET OR STRIP

[75] Inventors: Yakichiro Kawamo; Yozo Suga; Tadao Nozawa; Tadashi Nakayama, all of Kitakyushu, Japan

[73] Assignee: Nippon Steel Corporation, Tokyo, Japan

[21] Appl. No.: 411,001

[22] Filed: Aug. 24, 1982

[30] Foreign Application Priority Data

Dec. 11, 1981 [JP] Japan ..... 56-198443

[51] Int. Cl.[4] ..... H01F 1/04

[52] U.S. Cl. ..... 148/111; 148/120

[58] Field of Search ..... 148/110, 111, 112, 113, 148/120

[56] References Cited

U.S. PATENT DOCUMENTS

| | | | |
|---|---|---|---|
| 3,855,019 | 12/1974 | Salsgiver et al. | 148/111 |
| 3,908,432 | 9/1975 | Ichiyama et al. | 148/111 |
| 3,957,546 | 5/1976 | Fiedler | 148/111 |
| 3,960,616 | 6/1976 | Evans et al. | 148/112 |
| 3,990,924 | 11/1976 | Matsumoto et al. | 148/112 |
| 4,437,910 | 3/1984 | Nozawa et al. | 148/111 |

FOREIGN PATENT DOCUMENTS

| | | |
|---|---|---|
| 40-15644 | 7/1965 | Japan . |
| 47-25250 | 7/1972 | Japan . |
| 55-58332 | 6/1980 | Japan . |
| 55-73818 | 6/1980 | Japan . |
| 57-134519 | 8/1982 | Japan . |
| 988047 | 3/1965 | United Kingdom . |

*Primary Examiner*—John P. Sheehan

*Attorney, Agent, or Firm*—Cushman, Darby & Cushman

[57] ABSTRACT

In conventional processes for producing a grain-oriented electromagnetic steel strip or sheet, the carbon and silicon content of the starting material is such that $\alpha$-$\gamma$ transformation takes place, said transformation formerly being belived to play an important role in, for example, the formation of AlN. Recently, attempts have been made to reduce the carbon content so as to simplify decarburization-annealing, but these attempts have not been successful.

In the present invention, (1) an extremely low carbon content ($C \leqq 0.02\%$) and an extremely low sulfur content ($S \leqq 0.015\%$), as well as a low heating temperature of the starting material, and (2) a temperature gradient of at least 2° C. per centimeter, which is generated parallel to the sheet surface and under which the growth of secondary recrystallized grains is completed, are combined. As a result of such combination, the following advantages are attained: (1) secondary recrystallization is attained without $\alpha$-$\gamma$ transformation taking place; (2) a high magnetic flux density is attained; (3) a continuous-casting machine can be directly combined with a continuous hot-rolling mill; (4) decarburization-annealing can be simplified; and (5) no molten slag is formed during heating of a steel slab.

8 Claims, 7 Drawing Figures

Figure 3D:
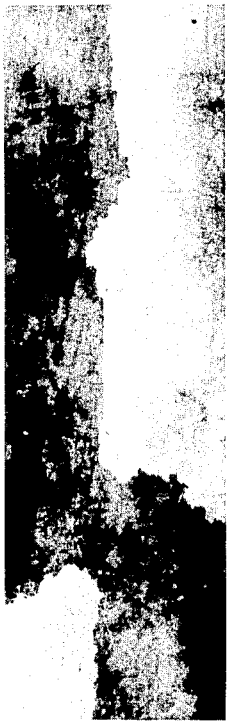
Figure 3E:
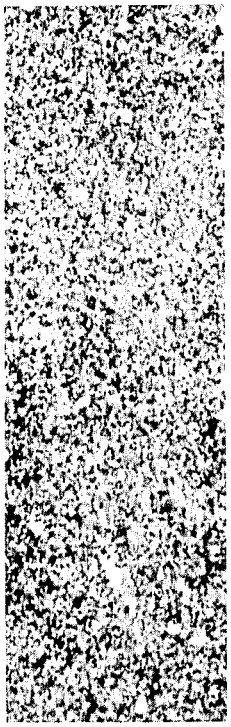

Fig. 3A
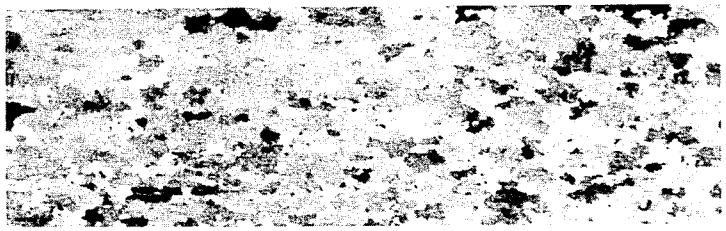
Fig. 3B
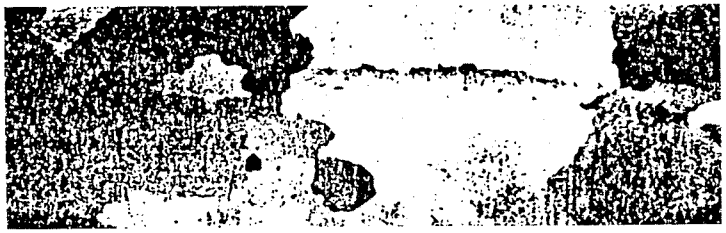
Fig. 3C

PROCESS FOR PRODUCING A GRAIN-ORIENTED ELECTROMAGNETIC STEEL SHEET OR STRIP

The present invention relates to a process for producing a grain-oriented electromagnetic steel sheet or strip.

In a conventional so-called one-stage cold-rolling process for producing a grain-oriented electromagnetic steel sheet, the silicon steel material contains approximately 0.04% of carbon, approximately 3% of silicon, and inhibitor elements, such as manganese, sulfur, aluminum, and nitrogen. A continuously cast slab consisting of the silicon steel material mentioned above is used as the starting material of a conventional so-called single-stage cold rolling process. When the carbon content and silicon content are less than and more than above mentioned values no $\alpha$-$\gamma$ transformation occurs at a high temperature. A continuously cast slab is heated to a temperature of 1300° C. or higher so as to dissolve the inhibitor elements into a solid solution, successively followed by hot-rolling, hot-coil annealing, cold-rolling, decarburization-annealing, the application of an annealing separator, and batch annealing. The aim of batch annealing is to secondarily recrystalize and desulfurize, denitrify, a silicon steel sheet. One of the features of the conventional single-stage cold-rolling process mentioned above is that although $\alpha$-$\gamma$ transformation occurs due to the composition of the starting material, a single $\alpha$-phase, which is indispensable for secondary recrystallization, can be formed in a silicon steel sheet which is being secondarily recrystallized. That is, due to decarburization-annealing, the carbon content is reduced from that of the starting material to that at which a single $\alpha$-phase can be formed. Another feature of the conventional single-stage cold-rolling process mentioned above is that $\alpha$-$\gamma$ transformation plays an important role in finely precipitating and dispersing AlN, which is one of the inhibitors, and in refining the matrix of steel sheet or strip before the secondary recrystallization. The conventional single-stage cold-rolling process makes it possible to produce a grain-oriented electromagnetic steel sheet or strip having excellent magnetic properties in the rolling direction but involves the following disadvantages:

(1) Since the composition of the starting material is such that $\alpha$-$\gamma$ transformation takes place at a temperature lower than the secondary recrystallization temperature, it is necessary to change the composition of the steel prior to batch annealing so that the steel is composed of a single $\alpha$-phase.

(2) In the starting material (Fe-3% Si-0.04% C) containing approximately 0.04% of carbon and approximately 3% of silicon, an increase in the silicon content improves the watt loss and decreases the amount of $\gamma$-phase. The carbon content must therefore be increased so as to compensate for the decrease in the amount of $\gamma$-phase and thus ensure that the amount of carbon necessary for the features described above is present. A simultaneous increase in the carbon content and the silicon content synergetically deteriorates the cold-rolling workability of the steel. Therefore, the silicon content could not be made high.

(3) Since the starting material contains carbon, nitrogen, and sulfur in such an amount that if they remain in the final product its magnetic properties are deteriorated, purification-annealing is necessary for removing these elements.

(4) A high heating temperature of a continuously cast slab and annealing of a hot-rolled strip at a high temperature are indispensable for finely precipitating and dispersing inhibitors.

The present invention aims to provide a process for producing a grain-oriented electromagnetic steel sheet or strip in which process at least one of the above-mentioned disadvantages and as many as possible of the above-mentioned disadvantages are eliminated and by which process the magnetic properties of a grain-oriented electromagnetic steel sheet or strip are furthermore improved over those attained by means of a conventional single-stage cold-rolling process.

It is an object of the present invention to eliminate the disadvantages of prior art in which appropriate dispersion state of inhibitors is attained by utilizing the $\alpha$-$\gamma$transformation. That is, by using starting material having no $\alpha$-$\gamma$ transformation the secondary recrystallization is attained after hot rolling.

It is another object of the present invention to provide a process in which the carbon content of the starting material is very low due to decarburization of the molten steel and in which decarburization of the steel when the steel is in a solid state can be omitted or simplified.

It is a further object of the present invention to provide a process in which even if the silicon content is increased the cold-rolling workability is not impaired.

It is yet another object of the present invention to provide a process in which the slab-heating temperature is decreased to a temperature lower than 1300° C.

It is still another object of the present invention to provide a process in which purification-annealing is omitted or simplified.

The present inventors investigated, by performing experiments, the conditions under which secondary recrystallization occurs even if the carbon content of the starting material is extremely low so as to accomplish the objects mentioned above. As a result of previous experiments performed by the present inventors in which 3% silicon steel slabs containing a conventional amount of carbon was used, it was found that: when a hot-rolled steel sheet is decarburized, secondary recrystallization becomes difficult as compared with a case in which a cold-rolled steel sheet is decarburized; but secondary recrystallization occasionally takes place even in a case in which decarburization is carried out regarding a hot-rolled steel sheet. Before initiating the experiments, the present inventors noticed that: (1) carbon has an inherent effect on secondary recrystallization and (2) carbon tends to form a $\gamma$-phase which also has an effect on secondary recrystallization. The present inventors recognized that it is necessary to elucidate whether (1) or (2) makes secondary recrystallization difficult in a case in which an extremely lowcarbon steel is used as the starting material. In addition, the present inventors previously considered the conditions of secondary recrystallization in a case in which an extremely low-carbon steel is used as the starting material and made the following conclusions: (1) One of the conditions is that the nuclei of the secondary recrystallized grains are present in the steel and have a (011)[100]orientation. This condition is satisfactory even if an extremely low-carbon steel is used as the starting material. (2) Another condition is that the radius of curvature of the nuclei of the secondary recrystallized grains is satisfactorily greater than the radius of curvature of the matrix grains. (3) Yet another condition is that inhibitors are present in the steel. The latter two conditions are difficult to achieve when an extremely low-carbon steel is used as the starting material.

Japanese Unexamined Patent Publication No. 55-58332(1980) and Japanese Unexamined Patent Publication No. 55-73818(1980) involve concepts which were conceived by the present inventors and disclose how the above-mentioned two conditions, which are difficult to achieve, can be achieved so that secondary recrystallization can take place. In these two Japanese unexamined patent publications, pure-iron slabs, in which silicon and iron are incorporated and in which the content of other elements is reduced as much as possible, as well as slabs which are produced in a steel-making mill and contain impurities, are used as the starting material and are hot-rolled. The prior art described in these two Japanese unexamined patent publications has, however, a disadvantage in that poor secondary recrystallization occasionally takes place. The present inventors discovered that the disadvantage mentioned above can be eliminated and that a final product having a good secondary recrystallization orientation and a high magnetic flux density can be obtained by carrying out secondary recrystallization while generating a predetermined temperature gradient parallel to the sheet surface. The present invention is therefore based on this dscovery and is characterized in that a steel slab, which contains not more than 0.02% of carbon, not more than 5% of silicon, not more than 0.015% of sulfur, from 0.01% to 0.08% of acid-soluble aluminum, and not more than 0.01% of nitrogen, is heated to a temperature of not more than 1270° C., is hot-rolled, followed by annealing of the hot-rolled strip, and is subsequently cold-rolled once, and, further, the resultant cold-rolled strip is subjected to primary recrystallization annealing and then to high-temperature finishing-annealing during which the growth of secondary recrystallized grains is completed under a condition in which a temperature gradient of at least 2° C. per centimeter is generated parallel to the sheet surface.

The present invention is hereinafter described in more detail.

First, the composition of a steel slab is described. When the silicon content exceeds 5%, it is difficult to cold-roll a hot-rolled strip. In the present invention, the maximum silicon content is higher than the conventional silicon content. In the present invention, such high silicon content does not result in deterioration of the cold-rolling workability because the carbon content is low. Nevertheless, when the silicon content exceeds 5%, coldrolling becomes difficult. The carbon content is 0.02% at the maximum because when the carbon content exceeds 0.02% a grain-oriented electromagnetic steel strip or sheet tends to have a defective portion where no secondary recrystallization occurs. The acid-soluble aluminum content lies within the range of from 0.010% to 0.080%. Otherwise, it is not possible to ensure that the amount of AlN which is necessary for secondary recrystallization will be precipitated as dispersion phases, with the result that a high magnetic flux density cannot be attained. Nitrogen and acid-soluble aluminum are elements which form AlN. When the nitrogen content exceeds 0.01%, flaws are liable to be generated in a steel slab, with the result that recovery in the production of a hot-rolled strip is reduced.

Sulfur content of 0.015% at the maximum is one of the significant features of the present invention.

The present invention is hereinafter described with reference to the drawings.

Figure 1:
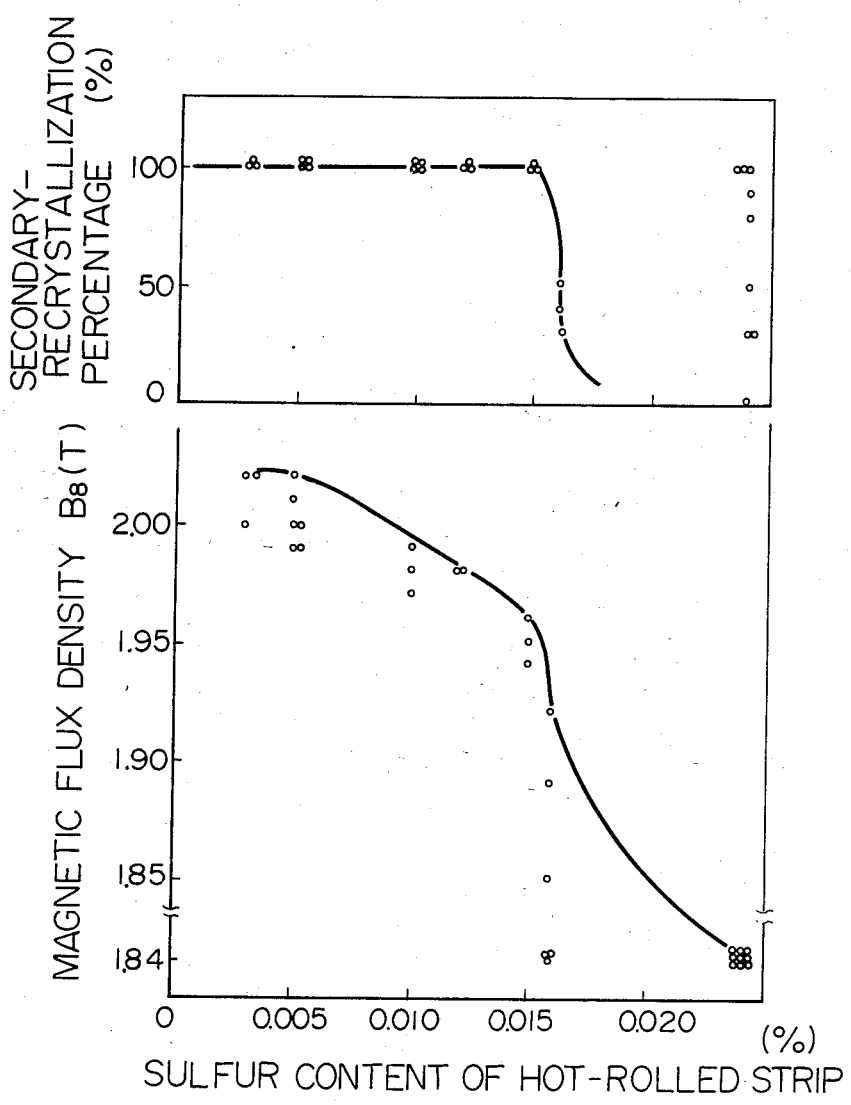
Figure 2:
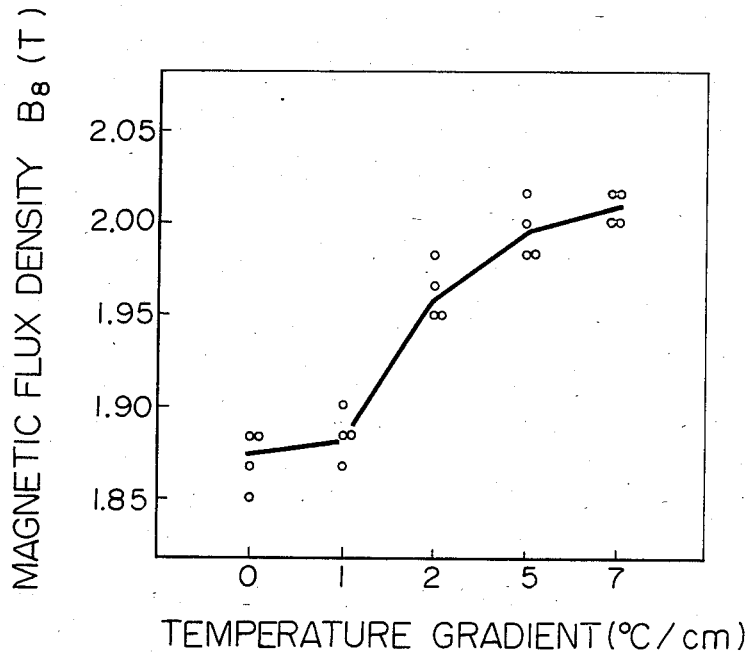

In the drawings:

FIG. 1 graphically illustrates how the sulfur content of a hot-rolled strip exerts an influence on the percentage of secondary recrystallization and the magnetic flux density $B_8$;

FIG. 2 graphically illustrates how the temperature gradient, under which the growth of secondary recrystallized grains is completed, exerts an influence on the magnetic flux density $B_8$; and FIG. 3A through 3E are macro-structure photographs of grain-oriented electromagnetic steel sheets.

As is apparent from FIG. 1, when the sulfur content of a hot-rolled strip exceeds 0.015%, the percentage of secondary recrystallization is less than 100%, and the magnetic flux density B8 is very low, even if the percentage of secondary recrystallization is 100%. Contrary to this, a sulfur content of 0.015%, preferably 0.002%, at the maximum enables a high magnetic flux density to be stably obtained.

Conventionally, sulfur is recognized as being useful in the production of a grain-oriented electromagnetic steel sheet or strip since it is one of the elements for forming MnS, which must be precipitated as dispersion phases so as to attain secondary recrystallization, as is disclosed in Japanese Examined Patent Publication No. 40-15644 (1965) and Japanese Examined Patent Publication No. 47-25250 (1972). The present inventors, however, discovered that in the process of the present invention based on the low-heating temperature of a steel slab, the sulfur content should be lessened so as to enhance the magnetic flux density of a grain-oriented electromagnetic steel sheet or strip.

FIG. 3A through 3E illustrate how the acid-soluble aluminum content i.e., 0.0005%, 0.02% 0.04%, 0.06% and 0.10%, respectively, of steel slabs exerts an influence on secondary recrystallization, the growth of secondary recrystallized grains being completed under a temperature gradient of 2° C. per centimeter in the short width direction of steel strips.

According to the embodiments of the present invention, the carbon content of a steel slab is from 0.003% to 0.02%, preferably from 0.003% to 0.005%.

According to one embodiment, the sulfur content of a steel is preferably not more than 0.005%.

The production steps of the process according to the present invention are described.

When a steel slab is heated to a temperature of more than 1270° C., the crystal grains of the steel slab tend to coarsen, with the result that the metal structure of the hot-rolled strip, particularly the texture and uniformity of the crystal grains, becomes inappropriate. Thus, streaks which are continuous in the rolling direction are generated in a grain-oriented electromagnetic steel sheet or strip. In addition, when a steel slab is heated to a temperature of more than 1270° C., such disadvantages as the formation of molten slag and flaws on the steel slab result. Therefore, the heating temperature of a steel slab is 1270° C. at the highest in the present invention. When the heating temperature of a steel slab is less than 1050° C., the driving force for the continuous hot-rolling will become very high and the shape of the hot-rolled strip becomes poor. The heating temperature of a steel slab is therefore desirably 1050° C. at the lowest. A heating temperature of 1270° C. at the highest of a steel slab is effective for preventing grain coarsening of the steel slab and for refining and making uniform the primary recrystallized grains, with the result that streaks are not likely to be generated. The effectiveness of this heating temperature is particularly outstanding in the present invention in which the growth of secondary recrystallized grains is completed under a condition in which a temperature gradient of at least 2° C. per centimeter is generated parallel to the sheet surface. More specifically, if the metal structure, particularly the texture and uniformity of the crystal grains, in portions of hot and then cold-rolled strips, are liable to cause streaks to form in the final product the growth of secondary recrystallized grains stops at these portions so that even if the temperature gradient mentioned abvoe is generated in these portions, the secondary recrystallized grains cannot consume the primary recrystallized grains, which are contiguous to said secondary recrystallized grains via these portions.

After hot-rolling of a steel slab, annealing of the hot-rolled strip is carried out so as to homogenize the metal structure and precipitates distribution in the short width and longitudinal directions of the hot-rolled strip. Continuous annealing of a hot-rolled strip is preferable to box annealing in the light of uniformity in the short width and longitudinal directions of the strip, as well as in the light of the pickling property of the scale, which is removed by means of pickling after annealing of the hot-rolled strip. Annealing of a hot-rolled strip is desirably carried out at a temperature of 750° C. to 1050° C. for a short period of time. When the annealing temperature exceeds 1050° C., the crystal grains undesirably coarsen which when the annealing temperature is lower than 750° C., it is difficult to homogenize the metal structure and distribution of precipitates in the short width and longitudinal directions of the hot-rolled strip.

In the present invention, a hot-rolled and then annealed strip is cold-rolled once at a rolling reduction ratio of preferably from 80%. The resultant cold-rolled strip is primary recrystallization-annealed so that an annealing separator can later be appropriately applied on the sheet surface and, furhter, so that decarburization, which is necessary in the case of a carbon content of not less than 0.003%, is attained. Any type of box annealing or continuous annealing can be employed for decarburization-annealing. Continuous annealing is, however, preferable because by this means the metal structure can be homogenized. The continuous-annealing condition may be a conventional one and the annealing temperature may be from 800° C. to 900° C.

Subsequently, an annealing separator is applied on a primary recrystallization-annealed steel strip, and such steel strip is then laminated and subjected to high-temperature finishing-annealing. During high-temperature finishing-annealing, the growth of secondary recrystallized grains is completed under a condition in which a temperature gradient of at least 2° C. per centimeter is generated parallel to the sheet surface. The significance of this temperature gradient is described with reference to FIG. 2.

Four molten steels containing 0.003% of carbon, 3.2% of silicon, 0.10% of manganese, 0.003% of sulfur, 0.0080% of nitrogen, and from 0.028 to 0.036% of acid-soluble aluminum were continuously cast so as to produce four steel slabs. The steel slabs were heated to 1180° C., were hot-rolled, and were coiled at a temperature of 550° C. The resultant 2.3-mm thick hot-rolled strips were subjected to continuous annealing, during which they were soaked at a temperature of 1050° C. for 1.5 minutes. The hot-rolled strips were cold-rolled once so as to produce cold-rolled strips having a thickness of 0.30 mm and then were subjected to primary recrystallization-annealing at a temperature of 850° C. for 1 minute in dry hydrogen. An annealing separator consisting of MgO was applied on the primary recrystallization-annealed strips, which were then cut into sections. The section were laminated and were charged into a one-meter long furnace divided into three zones. The laminated sections were heated at a temperature elevation rate of 20° C./hour, and the temperature of the three separate zones of the furnace was controlled in such a manner that a temperature gradient of 0° C./cm, 1° C./cm, 2° C./cm, 5° C./cm, and 7° C./cm, respectively, was generated in direction perpendicular to the rolling direction. After heating the laminated sections at the temperature elevation rate mentioned above, purification-annealing was carried out at a temperature of 1200° C. for 10 hours in a hydrogen atmosphere. The magnetic flux density $B_8$ of the resultant final products is given in FIG. 2. As is apparent from FIG. 2, when the temperature gradient was at least 2° C. per centimeter, the magnetic flux dinsity $B_8$ was higher than 1.94 tesla. The higher the temperature gradient is the higher is the magnetic flux density $B_8$ is.

Although secondary recrystallization is stabilized by increasing the temperature gradient, the width of the 180° magnetic domains is increased in accordance with the large growth of secondary recrystallized grains, with the result that watt loss may be increased. Therefore, if division of the 180° -magnetic domains is carried out by means of a known mechanical or laser-beam irradiation method, a high-level temperature gradient can be selected so as to stabilize secondary recrystallization and thus attain a high magnetic flux density $B_8$. If the division mentioned above is not carried out, the temperature gradient is adjusted so as to attain the lowest watt loss. For these reasons, the highest temperature gradient is not specified.

Incidentally, the direction of a steel strip or sheet in which the temperature gradient is generated parallel to the sheet surface may be either the short width direction or the longitudinal direction or a non-specified plurality of directions. Provided that a temperature gradient of at least 2° C. per centimeter is generated on the border between the primary and secondary recrystallized regions of a steel strip or sheet, the temperature gradient may be constant in a high-temperature finishing-annealing furnace or may be varied in the direction of the temperature gradient.

Recently, due to the development of a continuous-casting technique, the productivity of a continuous-casting machine is increased so that it is comparable to that of a continuous hot-rolling mill. Therefore, a continuous-casting machine can be directly combined with a continuous hot-rolling mill, and continuously cast steel slabs can be directly supplied to a continuous hot-rolling mill without delay.

Since a high magnetic flux density can be obtained even if the heating temperature of a steel slab is low, i.e., not more than 1270° C., the advantageous hot-rolling methods mentioned below can be employed in the production of a grain-oriented electromagnetic steel strip or sheet. One of these advantageous hot-rolling methods involves directly hot-rolling a steel slab by utilizing the sensible heat of the steel slab, thereby avoiding cooling of the steel slab which, in turn necessitates reheating of the steel slab. Another hot-rolling method involves charging a steel slab into a furnace and heating it only to the extent that the temperature distribution of the steel slab is homogenized. After the temperature, especially the surface temperature, of the steel slab is slightly lowered, the slab is charged into a heat-recuperating furnace or a heating furnace for conventional carbon steels, thereby homogenizing the temperature distribution in the steel slab for a short period of time. Subsequently, the slab is hot-rolled. These types of hot-rolling are frequently carried out with regard to conventional carbon steels but cannot be employed in the production of a grain-oriented electromagnetic steel strip or sheet since a high-temperature heating furnace must conventionally be provided specifically for a steel slab which is used as the starting material of a grain-oriented electromagnetic steel sheet or strip and which is heated at a high-temperature for a long period of time. A continuous-casting machine, therefore, cannot conventionally be directly combined with a continuous hot-rolling mill in the production of a grain-oriented electromagnetic steel sheet or strip. In accordance with the process of the present invention, a grain-oriented electromagnetic steel sheet or strip can be hot-rolled at a cost as low as that and at a productivity as high as that of conventional carbon steels.

In addition, because the silicon content of a grain-oriented electromagnetic steel sheet or strip is high, the thermal conductivity of the steel slab is low. When a steel slab is cooled down toward room temperature, the difference in temperature between the surface and central portions of the steel slab becomes so great due to the low thermal conductivity mentioned above that the thermal stress generated in the steel slab causes the formation of internal cracks. However, since such cooling of a steel slab can be avoided in the present invention by directly combining a continuous-casting machine with a direct hot-rolling mill, the generation of internal cracks can be avoided and recovery of hot-rolling can be very high. As can be understood from the above descriptions, a low heating temperature of a continuously-cast steel slab brings about various advantages. However, not only a coutinuously-cast steel slab but also a steel slab produced by a rough-rolling method can obviously be used as the starting material of the process of the present invention.

Several embodiments of the process according to the present invention are hereinafter described.

Decarburization and desulfurization of molten steel are carried out so that the carbon and sulfur contents of the molten steel are 0.02% at the maximum and 0.015% at the maximum, respectively. Decarburization can be carried out by means of a vacuum-degassing method, such as the RH or DH method, or an argon-oxygen blowing method, such as the AOD method.

Alloying elements, such as silicon, aluminum, and manganese, are added to the molten steel so as to adjust the steel chemistry and then a steel slab is obtained by continuous casting.

The continuously-cast steel slab is hot-rolled while a high temperature is maintained. Alternatively, the continuously-cast steel slab is cooled, is charged into a furnace, is heated to a temperature of from 1050° C. to 1270° C., and is then hot-rolled.

Cold-rolling is carried out by either continuous rolling or reversible rolling. Primary recrystallization-annealing is preferably carried out in a continuous-annealing furnace and in a wet gas containing hydrogen. High-temperature finishing-annealing is carried out in the steel sheet or strip with the portions of the steel sheet or strip being separated from one another with an annealing separator. An annealing separator is applied on the resultant primary recrystallized cold-rolled strip, said strip is subsequently tightly coiled, and the coil is placed in a high-temperature finishing annealing furnace so that the short width direction of the coil is vertically oriented. In addition, the outer and inner peripheral surfaces of the coil are covered with heat-insulating material so as to prevent heat conduction in a direction perpendicular to the sheet surface of the coil. Heat is then applied to the coil from either an upward or downward direction or from both an upward and downward direction during heat-temperature finishing-annealing. The temperature gradient mentioned above is created by successively removing the heat-insulating material and thus successively exposing the inner and outer peripheral surfaces of the coil within the high-temperature finishing-annealing furnace. After completion of the growth of secondary recrystallized grains under a temperature gradient of at least 2° C. per centimeter, purification-annealing is carried out at a temperature of from 1000° C. to 1250° C.

Subsequently, the grain-oriented electromagnetic steel sheet or strip is subjected to the application of an insulating film and to division of the 180° magnetic domains, if necessary.

According to the process of present invention, a high magnetic flux density can be stably obtained, and, therefore, the grain-oriented electromagnetic steel sheet or strip produced by the process of present invention is particularly suited for the core of a transformer.

The present invention is hereinafter described with reference to the examples.

EXAMPLE 1

Molten steel containing 3.1% of silicon, 0.005% of carbon, 0.08% of manganese, 0.033% of acid-soluble aluminum, 0.008% of nitrogen, and 0.005% of sulfur was continuously cast so as to produce a steel slab. The steel slab was heated to 1180° C., was hot-rolled to a thickness of 2.3 mm, and was coiled at a temperature of 550° C. The resultant hot-rolled strip was subjected to continuous annealing, during which it was soaked at a temperature of 950° C. for 1.5 minutes. The hot-rolled strip was then cold-rolled so as to obtain a cold-rolled strip having a thickness of 0.30 mm. Subsequently, the strip was subjected to primary recrystallization-annealing at a temperature of 850° C. for 1.5 minutes in wet hydrogen. An annealing separator was applied on the primary recrystallization-annealed steel strip and then the strip was dried and cut into sections. The cut steel sections were laminated and then were charged into a one-meter long furnace divided into three zones. The cut steel sections were heated at a temperature elevation rate of 20° C./hour. During temperature elevation, the temperature of the three zones of the furnace was controlled in such a manner that the temperature gradient generated parallel to the rolling direction was 5° C. per centimeter in portions of the steel sections, and the temperature in these portions was in the secondary recrystallization range, i.e., from 850° C. to 1000° C. Directly after completion of the growth of secondary recrystallized grains under the temperature gradient mentioned above, purification-annealing was carried out at a temperature of 1200° C. for 20 hours in pure hydrogen. The resultant magnetic flux density $B_8$ was 1.98 Tesla.

EXAMPLE 2

Molten steel having the composition shown in Table 1 was continuously cast so as to produce a steel slab. The steel slab was heated to 1180° C., was hot-rolled to a thickness of, 2.3 mm and was coiled at a temperature of 550° C. The resultant hot-rolled strip was subjected to continuous annealing, during which it was soaked at a temperature of 950° C. for 1.5 minutes. The hot-rolled strip was then cold-rolled so as to obtain a cold-rolled strip having a thickness of 0.30 mm. Subsequently, the strip was subjected to primary recrystallization-annealing at a temperature of 850° C. for 3 minutes in wet hydrogen. An annealing separator was applied on the primary recrystallization-annealed steel strip and then the strip was dried and cut into sections. The cut steel sections were laminated and then were charged into a one-meter long furnace divided into three zones. The cut steel sections were subjected to high-temperature finishing-annealing under the same conditions as in Example 1. The resaltant magnetic flux density $B_8$ is given in Table 1.

TABLE 1

| Steel | Composition (wt %) C | Si | Mn | S | Sol.Al | N | Magnetic Flux Density $B_8$ (T) |
|---|---|---|---|---|---|---|---|
| A (invention) | 0.003 | 3.20 | 0.090 | 0.005 | 0.035 | 0.0080 | 1.99 |
| B (control) | 0.003 | 3.15 | 0.088 | 0.005 | 0.008 | 0.0085 | 1.87 |
| C (control) | 0.003 | 3.20 | 0.090 | 0.003 | 0.095 | 0.0080 | 1.84 |
| D (control) | 0.050 | 3.20 | 0.090 | 0.005 | 0.033 | 0.0085 | 1.57 |

Steel A having the composition specified in the present invention had a high magnetic flux density $B_8$. The magnetic flux density of steels B and C, the aluminum content of which did not fall within the specified range, and of steel D, the carbon content of which exceeded the specified maximum content, was low.

We claim:

1. A process for producing a grain-oriented electromagnetic steel sheet or strip, characterized in that a steel slab containing not more than 0.02% of carbon, not more than 5% of silicon, not more than 0.015% of sulfur, from 0.01% to 0.08% of acid-solution aluminum, and not more than 0.01% of nitrogen is heated to a temperature of not more than 1270° C. and hot-rolled with no $\alpha$-$\gamma$ transformation taking place followed by annealing of the hot-rolled strip at a temperature of from 750° C. for a period of less than 10 minutes, and is subsequently cold-rolled once, and, further, the resultant cold-rolled strip is subjected to primary recrystallization-annealing and then to high-temperature finishing annealing in which the growth of secondary recrystallized grains is completed under a condition in which a temperature gradient of at least 2° C. per centimeter is generated parallel to the sheet surface.

2. A process according to claim 1, wherein said high-temperature finishing-annealing is carried out in a steel sheet or strip, the portions of said steel sheet or strip being separated from one another with an annealing separator.

3. A process according to claim 1, wherein said steel slab is produced by continuous casting and is then directly hot-rolled by utilizing the sensible heat thereof.

4. A process according to claim 1, wherein said steel slab is charged into a furnace and is heated only to the extent that the temperature distribution of said steel slab is homogenized.

5. A process according to claim 1, wherein the carbon content of said steel slab is from 0.003% to 0.02%.

6. A process according to claim 6, wherein the carbon content of said steel slab is from 0.003% to 0.005%.

7. A process according to claim 1, wherein the sulfur content of said steel slab is not more than 0.005%.

8. A process according to claim 1, wherein the sulfur content of said steel slab is not more than 0.002%.

* * * * *